US007819189B1

(12) United States Patent
Cosby

(10) Patent No.: US 7,819,189 B1
(45) Date of Patent: Oct. 26, 2010

(54) METHOD AND SYSTEM FOR DETERMINING PLUNGER LOCATION IN A PLUNGER LIFT SYSTEM

(75) Inventor: David D. Cosby, Fort Worth, TX (US)

(73) Assignee: Harbison-Fischer, L.P., Crowley, TX (US)

( * ) Notice: Subject to any disclaimer, the term of this patent is extended or adjusted under 35 U.S.C. 154(b) by 337 days.

(21) Appl. No.: 11/755,274

(22) Filed: May 30, 2007

Related U.S. Application Data

(60) Provisional application No. 60/811,212, filed on Jun. 6, 2006.

(51) Int. Cl.
*E21B 47/04* (2006.01)
*E21B 47/09* (2006.01)

(52) U.S. Cl. ..... 166/255.1; 166/250.01

(58) Field of Classification Search ..... 166/68, 166/250, 250.15, 255.11, 250.01; 367/81; 181/103, 123, 124
See application file for complete search history.

(56) References Cited

U.S. PATENT DOCUMENTS 4,523,465 A * 6/1985 Fasching et al. ..... 367/81
4,646,871 A 3/1987 Wolf
4,750,583 A 6/1988 Wolf
4,793,178 A 12/1988 Ahern et al.
2006/0054329 A1* 3/2006 Chisholm ..... 166/372
2006/0090893 A1* 5/2006 Sheffield ..... 166/250.15
2006/0102346 A1* 5/2006 Casey ..... 166/250.15
2008/0029272 A1* 2/2008 Bender ..... 166/372

OTHER PUBLICATIONS

National Research Council Canada-IRAP, Calgary Company Pioneers Acoustic Drilling Telemetry for the Oilpatch, Extreme Engineering Ltd., Calgary, Alberta, 2 pages.
Gas Tips, Wireless Gauge, Real Time Half Duplex Communications Wireless Gauge with Downhole Power Monitors Deep Well Gas Production, Scott Kruegel, Paul Tubel and Gary Covatch, Summer 2004 pp. 10-14.
PTTC Network News 1st Quarter 2005, Stripper Well Consortium (SWC) Selects 2005 Projects, Real Time Remote Field Monitoring of Plunger, Lift Wells (Tubel Technologies, Inc.) 1 page.
Tubel Technologies, Inc., About Tubel Technologies. www/tubeltechnologies.com, 2 pages.
Wireless Gauges for Real Time Downhole Data Acquisition, Tubel Technologies, Inc., www.tubeltechnologies.com, 3 pages.
The Expro Group, The Cableless Telemetry System, May 2005, 7 pages, www.exprogroup.com.
Data Retrieval Corporation, About DRC, www.spidr.com, 2 pages.
VEMCO-Resources-Tutorials-Transmitter Selection, Making Waves in Acoustic Telemetry, Transmitter Selection, www.vemco.com, 5 pages.
Plugging Specialists International ASA, PSI Datasheets, SmartTrack Pinger, 1 page.

* cited by examiner

*Primary Examiner*—Jennifer H Gay
*Assistant Examiner*—Michael Wills, III
(74) *Attorney, Agent, or Firm*—Geoffrey A. Mantooth

(57) ABSTRACT

A plunger has a transmitter that produces signals as the plunger moves in a well. The signals are pulses that are produced at a constant interval. The plunger signals are detected and used to determine the location, direction of travel and speed of the plunger in the well. In addition, the location or height of the liquid level is detected as is the arrival of the plunger at the well bottom.

12 Claims, 5 Drawing Sheets

METHOD AND SYSTEM FOR DETERMINING PLUNGER LOCATION IN A PLUNGER LIFT SYSTEM

This application claims the benefit of U.S. patent application Ser. No. 60/811,212, filed Jun. 6, 2006.

FIELD OF THE INVENTION

The present invention relates to plunger lift systems in producing wells, such as gas wells.

BACKGROUND OF THE INVENTION

In wells that produce both natural gas and oil, the gas and oil exit the formation and enter the perforated casing and tubing string that is located inside of the casing. The gas may flow up the casing or the tubing string, while oil and other liquids travel through the tubing string to the wellhead at the surface. The oil and other liquid are forced to the surface by way of either natural formation pressure or by artificial lifting mechanisms, such as pumps.

For wells whose primary purpose is to produce gas, the presence of liquid at the bottom of the well bore adds back-pressure to the formation, and thus inhibits the free flow of natural gas through the well bore to the surface. It has been estimated that 80% of the natural gas wells in the United States suffer from liquids (oil and/or condensates) in the well bore. This produces a condition known as liquid loading, wherein the ability of the well to produce a maximum amount of gas is restricted.

In order to restore production of a gas well to a satisfactory level, it is desirable to remove much of the liquid from the bottom of the well bore. The amount of liquid produced in many wells is insufficient to warrant a pump. Plunger lift systems are used instead. Additionally, plunger lift systems can function to produce oil through the tubing of an oil well in the same manner.

In a plunger lift system, a plunger cycles in the tubing between the top and the bottom of the well bore. As the plunger rises from the bottom of the well bore, it lifts the liquid above the plunger to the surface. Gas pressure below the plunger serves to lift the plunger and the liquid. The gas used to lift the plunger can be either gas produced by the formation or gas injected into the well from the surface. The plunger falls to the bottom by gravity, when the well is shut-in, and gas no longer flows. The plunger is cycled periodically to lift the liquid. Gas is typically produced through the tubing instead of the casing in a plunger lift system.

Because plunger lift systems are used to increase well production, there is a desire to optimize the operation of the plunger. The plunger is typically held at the surface by the either a mechanical latch or by the force of flowing gas in the tubing. A controller or operator determines when enough fluid has entered the bottom of the well bore and appropriate conditions exist, or will soon exist, that will allow the plunger to operate effectively. The well is then closed and the plunger free falls to the bottom of the well. The well is then opened so that the plunger will return to the surface.

Knowing when the plunger hits the bottom of the well is desirable. If the well is opened before the plunger has reached the bottom of the liquid column, the plunger will rise to the surface without a full load of liquid. Not only is this inefficient, but the plunger's rise speed may be too fast, damaging both itself and equipment at the top of the wellhead. The well can remain closed, or shut-in, for a long time to ensure that the plunger has reached the bottom. However, a shut-in well loses production.

Current practice uses estimates of plunger fall speeds and times. For example, estimates of fall speeds range from 250 feet per minute (fpm) to over 1500 μm, depending on the type of plunger. However, some published estimates have been proven to be significantly inaccurate when measured with acoustic test equipment, such as that manufactured by Echometer. It is recognized that the velocity of a plunger significantly decreases when the plunger enters gaseous liquid conditions. While estimated fall velocities in natural gas and gaseous liquid conditions can be approximated through empirical testing, it is necessary to know the height of the liquid column in the well.

Current practice allows the pressure exerted by the liquid column, and thus the height of the liquid column, to be determined measuring the tubing pressure and casing pressure shortly after the well is shut-in at the surface and then comparing the two pressures. However, the liquid gradient (psi/ft) must be known in order to determine the height of the liquid in the tubing and thus to accurately predict the time for the plunger to reach the bottom of the well. Because the liquid gradient depends on the gas content of the liquid, determining the liquid gradient absent direct measurement is difficult.

It also desired to know the position of the plunger in the tubing at all times. This information could be used by an operator to know in real time when the plunger will reach the bottom or top of the well. Knowing the plunger location could greatly assist operators in troubleshooting problems in a well, such as the location of a stuck plunger, in knowing the velocity of the plunger for cycle optimization, in ensuring that the plunger actually reached the bottom of the well before the well is opened, and even to schedule preventive maintenance.

Downhole instrumentation, which would sense parameters relating to the liquid level and fluid gradient, is one answer. But, obtaining data from the downhole instrumentation, and providing power thereto, is costly, time consuming and difficult. Transmitting the data over wires is not practical, as the wires inside of the tubing would interfere with the operation of the plunger. Also, prior art acoustical systems are used to determine well bore conditions, including plunger location. U.S. Pat. No. 6,634,426 is a passive system that uses a microphone at the surface to listen to the plunger rise and fall. The plunger makes acoustical signatures as it passes by collars or joints in the tubing string and when it contacts the liquid. U.S. Pat. No. 4,318,674 uses an acoustical source on the surface to determine the location of the top level of the liquid.

It is desired to improve on the prior art.

SUMMARY OF THE INVENTION

The present invention provides a plunger lift system for use in a well that comprises a plunger, a receiver and a controller. The plunger has a transmitter that produces signals. The plunger is capable of moving up and down in the well. The receiver is located so as to receive the signals from the plunger transmitter. The controller opens and closes the well. The controller is operatively connected to the receiver. The controller determines the location of the plunger in the well from the plunger signals.

In accordance with one aspect of the present invention, the plunger transmitter produces acoustical signals.

In accordance with another aspect of the present invention, the plunger further comprises the clock, with the plunger transmitter producing signals at a constant time interval.

In accordance with still another aspect of the present invention, the controller determines the velocity of the plunger in the well from the plunger transmitter signals.

In accordance with still another aspect of the present invention, the plunger lift system further comprises a transmitter located at the surface and operatively connected to the controller. A receiver is located in the plunger and is coupled to a controller in the plunger, the plunger controller controlling the operation of the plunger transmitter.

In accordance with still another aspect of the present invention, the controller determines a liquid level in the well from the plunger transmitter signals.

In accordance with still another aspect of the present invention, the plunger produces acoustical signals. The plunger has a clock, with the transmitter producing signals at a constant time interval. The controller determines the velocity of the plunger in the well from the signals and determines a liquid level in the well from the plunger transmitter signals.

The present invention provides a method of determining the location of a plunger in a plunger lift system for a well. The movement of the plunger in the well is controlled by opening and closing the well. The plunger transmits signals as the plunger moves within the well. The plunger signals are received. The location of the plunger in the well is determined from the plunger signals.

In accordance with another aspect of the present invention, the location of a gas-liquid interface in the well is determined from the plunger signals.

In accordance with another aspect of the present invention, the step of controlling the movement of the plunger in the well between the surface and the well bottom by opening and closing the well further comprises the step of using the location of the gas-liquid interface to determine when to open or close the well.

In accordance with still another aspect of the present invention, the pulses are transmitted by the plunger at a constant interval.

In accordance with still another aspect of the present invention, the direction of travel of the plunger in the well is determined from the plunger signals and intervals.

In accordance with still another aspect of the present invention, the location of a gas-liquid interface in the well is determined from the plunger signals and intervals.

In accordance with still another aspect of the present invention, the arrival of the plunger at the well bottom is detected from the plunger signals.

In accordance with still another aspect of the present invention, after detecting when the plunger has reached the well bottom, the well is opened.

BRIEF DESCRIPTION OF THE DRAWINGS

FIG. 4A shows the plunger at rest (stationary). FIG. 4B shows the plunger falling. FIG. 4C shows the falling plunger contacting the top level of the liquid in the tubing and then falling through the liquid. FIG. 4D shows the plunger rising.

DESCRIPTION OF THE PREFERRED EMBODIMENT

The present invention provides a plunger lift system with an energy source on the plunger. The energy source allows the movement of the plunger in the well to be tracked or monitored and allows the liquid level in the tubing to be detected.

Figure 1:
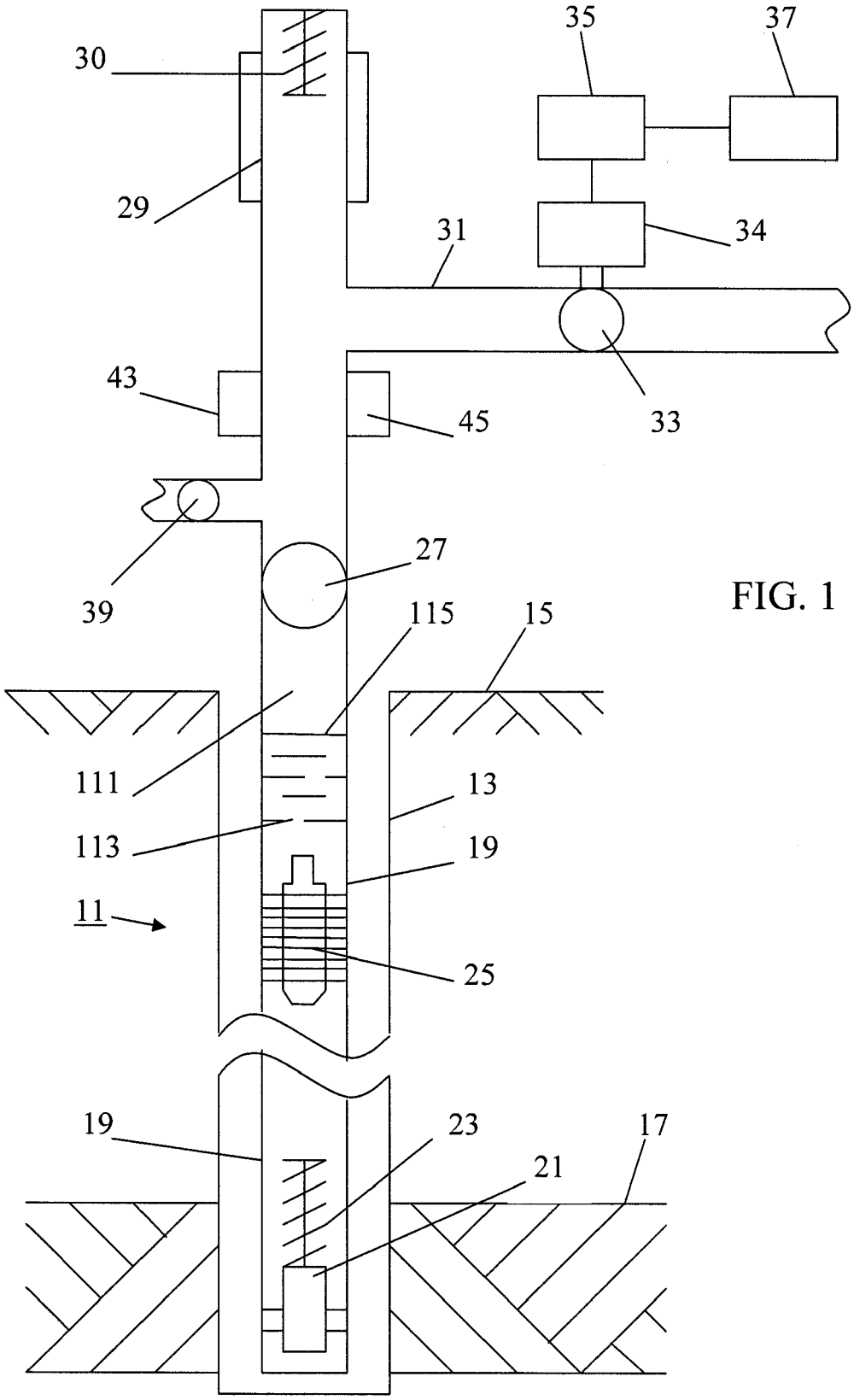
FIG. 1 is a schematic view of a well, with the plunger lifting system of the present invention, in accordance with a preferred embodiment.

A typical well 11 is shown in FIG. 1. The well has casing 13 that extends from the surface 15 down to the producing formation 17 or zone. A string of tubing 19 is located in the casing. At or near the bottom end of the tubing 19, there is a seating nipple 21 or tubing stop. Located above the seating nipple 21 is a bottom hole bumper spring 23. The bumper spring 23 can be provided with a standing valve, which valve prevents liquid from exiting the tubing and returning to the formation such as may occur when the plunger is falling through the liquid. A plunger 25 is provided to travel inside of the tubing 19.

Wellhead equipment at the surface caps the top of the casing. Various valves are provided, such as a master valve 27, which is manually operated. A lubricator 29 is located above the master valve 27. The lubricator 29 contains a bumper spring 30. Below the lubricator 29 is a sales line 31 which typically leads to a tank (not shown). A motor valve 33 is provided in-line with the sales line 31. The motor valve 33 is controlled by a solenoid valve 34 which in turn is controlled by a controller 35. The motor valve 33 has a spring and a diaphragm, which operate to open and close the valve. The solenoid valve 34 controls air flow into the motor valve to open and close the motor valve 33. A solar panel 37 may be provided to electrically power the controller 35. A solenoid operated low pressure vent valve 39 is located so as to vent gas from the tubing 19. The wellhead equipment can include other components such as discrete and differential pressure gauges, drip pots, ball valves, check valves, flow meters, chemical injection pumps, etc.

The controller is operatively connected to the arrival sensor 45 and other components by either wires or wirelessly.

A microphone 43 is provided. In the preferred embodiment, the microphone is located on the lubricator 29 so that acoustical signals from down inside the well 11, and in particular, acoustical signals from the plunger 25, are received. An arrival sensor 45 is located on the lubricator. The arrival sensor is typically a magnetic shut off switch or an acoustical receiver. In the preferred embodiment, the arrival sensor 45 is a proximity sensor.

Figure 2:
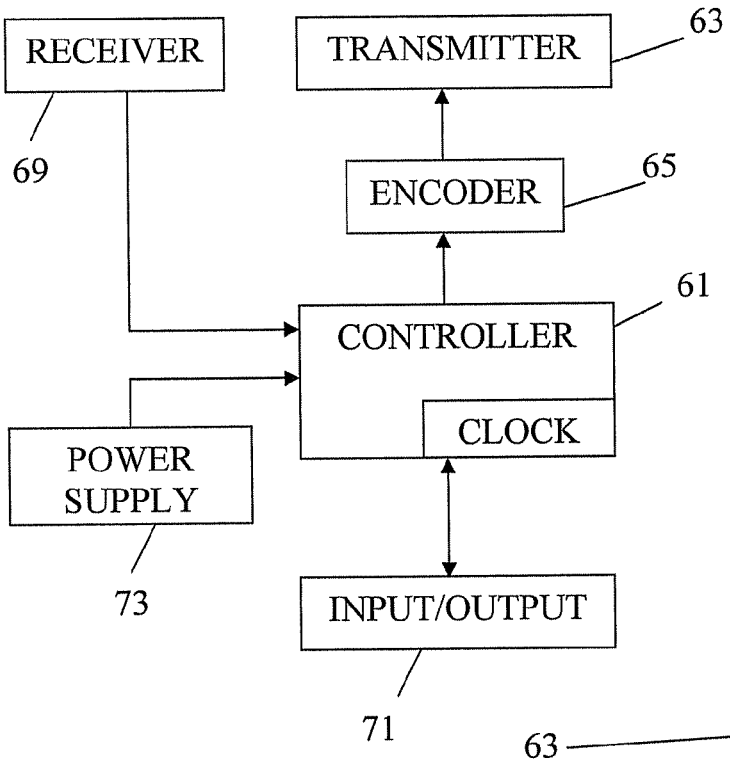
FIG. 2 is a block diagram illustrating the electrical components of the plunger.
Figure 2A:
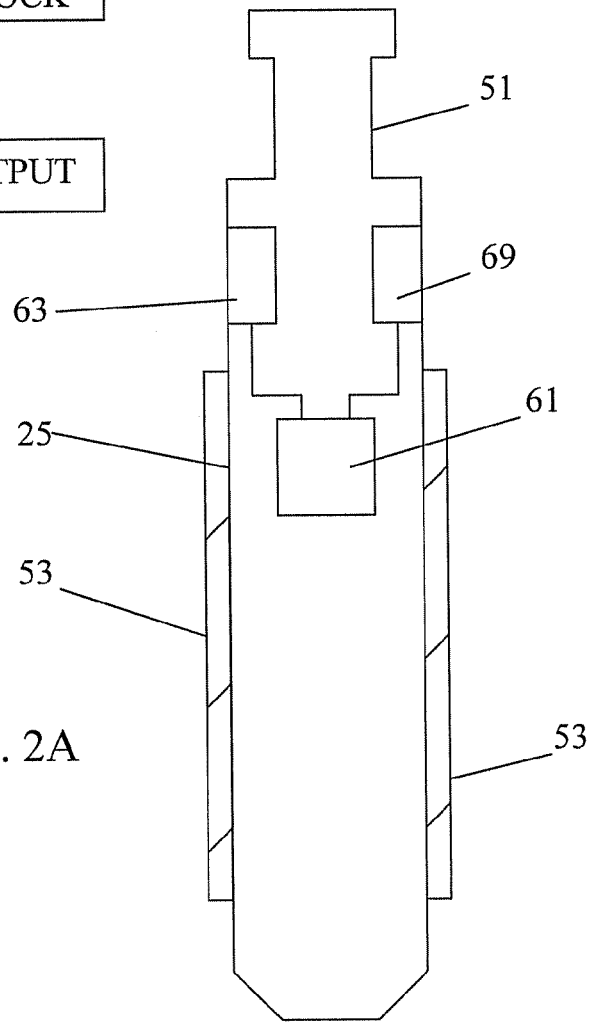
FIG. 2A is a diagram that illustrates a plunger with the electrical components therein.

Referring to FIG. 2A, the plunger 25 is elongated with a fishing neck 51 at its upper end. The plunger 25 is provided with conventional structure 53 that minimizes fluid leakage about the outside diameter of the plunger. For example, one type of plunger is a spiral plunger, which has a spiral lip forming the outside diameter. Between the spirals of the lip is a spiral groove. A spiral plunger is illustrated schematically in FIG. 1. Another type of plunger is a brush plunger which has flexible or resilient brushes for sealing against the tubing inside diameter. This type is shown in cross-section in FIG. 2A. Still another type of plunger is a pad plunger which has several pads that are spring loaded to extend out and engage the tubing inside diameter. Still another type of plunger utilizes a combination of types, such as spiral and brush, or spiral and pad or brush and pad. The plunger 25 can be equipped with a bypass valve, so as to allow fluid to flow through the plunger during the fall or descent. A bypass valve shortens the fall time.

The plunger 25 is also equipped with electronics. Referring to FIGS. 2 and 2A, the plunger has a controller 61, which has a microprocessor, a clock and memory, both volatile and non-volatile. The plunger 25 also has a transmitter 63 or energy source. In the preferred embodiment, the transmitter 63 is acoustical and generates acoustical signals. The transmitter is located so that the pulses propagate to the surface. The transmitter can propagate the pulses by way of fluid (liquid or gas) in the tubing or by way of the tubing wall. An encoder 65 converts the signals into a form suitable for transmission.

The plunger can operate continuously producing pulses. A manual on-off switch (not shown) is provided. Alternatively, the plunger can be turned on and off remotely. In the embodiment where the plunger can be remotely turned on and off, a receiver 69 is provided for receiving signals from the surface controller. The receiver 69 is connected to an input of the controller 61 and serves to enable and disable the controller.

Input and output ports 71 are provided in the plunger to allow programming of the controller. A power supply 73, typically batteries, powers the plunger electronics. FIG. 2 shows the main components of the plunger electronics.

The surface equipment will now be described with reference to FIG. 3. The surface controller 35 has a microprocessor 81, a clock 83 and memory. In addition, the surface controller has components for processing the signals from the microphone 43. The signal processing components are a signal amplifier 87 and an analog-to-digital converter 89.

The surface controller 35 operates the motor valve 33 (see FIG. 1) and the low pressure vent valve 39. The low pressure vent valve 39 is solenoid 90 operated. The surface controller 35 also has an input 91, such as a keypad, and an output 93, such as a display. The surface controller can be provided with a transmitter 95 for communicating with the plunger. One or more sensors 97 can be provided. Examples of sensors can be pressure sensors for determining pressure at particular locations such as casing, tubing or sales line. Still another type of sensor 97 is a gas flow rate meter. Still another type of sensor 97 senses the fluid level in the tank.

The plunger 25 electronics operates to transmit acoustical pulses. The plunger transmitter 63 sends a steady train of pulses. The intervals between the pulses are constant and are determined by the plunger clock in the controller 61. The plunger operates to continuously transmit pluses during its descent and ascent in the tubing 19.

Figure 3:
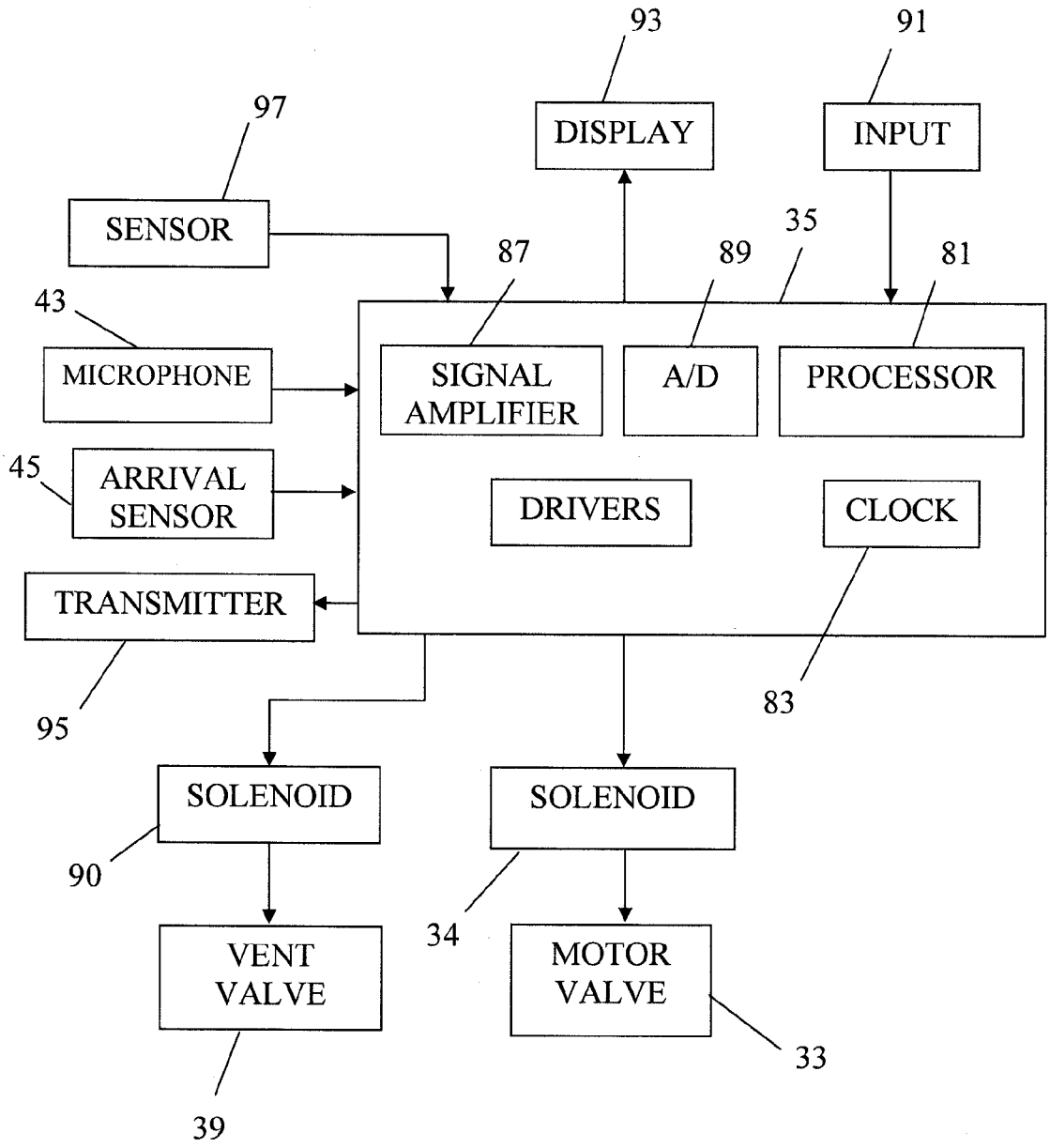
FIG. 3 is a block diagram that illustrates the electrical components of the surface equipment.
Figure 4A:
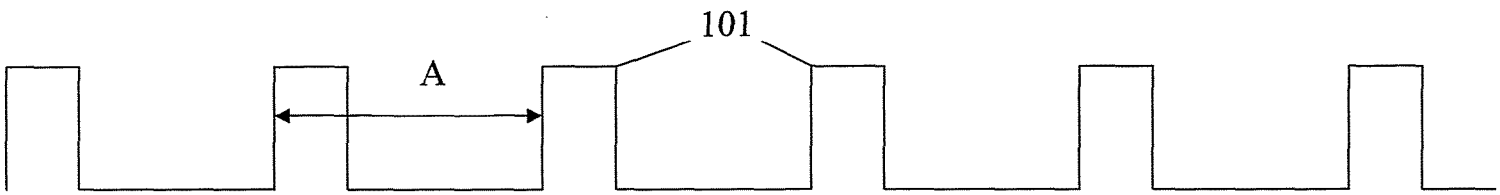
FIGS. 4A-4D are diagrams of plunger pulses received at the surface, with time as the horizontal axis.
Figure 4B:
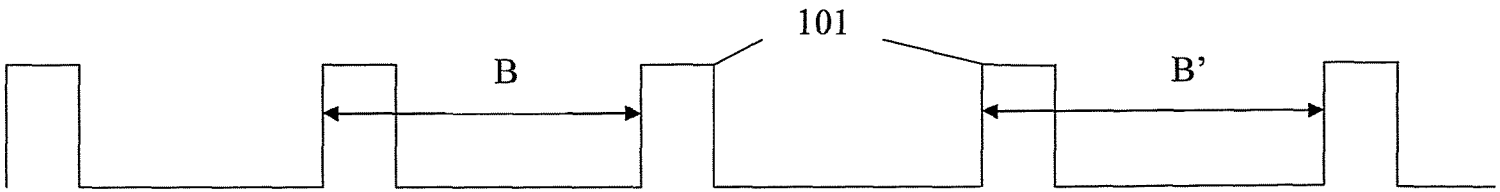
Figure 4C:
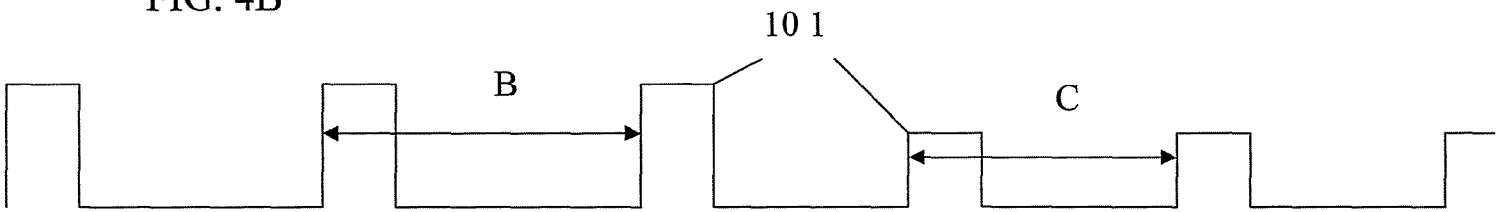
Figure 4D:
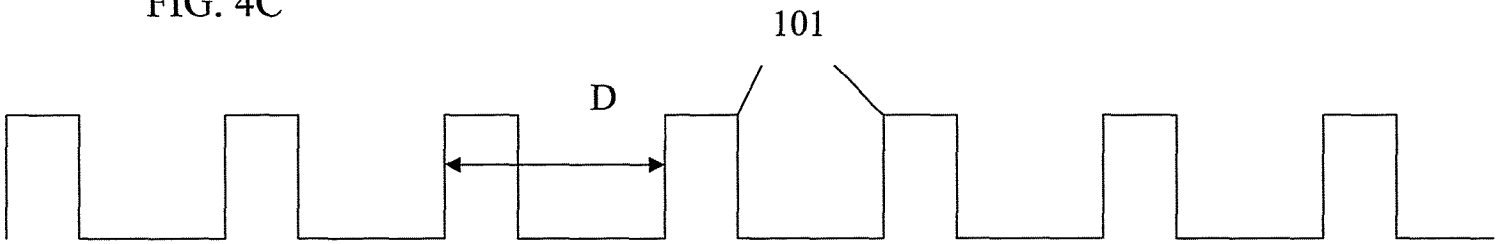

FIGS. 4A-4D show the plunger pulse train as received by the surface arrival sensor 45 (FIG. 3). In FIG. 4A, the plunger 25 is not moving. At the arrival sensor 45, the pulses 101 are at constant intervals A and amplitude. In FIG. 4B, the plunger 25 is falling and moving away during the arrival sensor 45. Due to the Doppler effect, the intervals B, B' between the pulses increases. The interval B is greater than the interval A. The interval B' is greater than the interval B. The pulse amplitude may decrease as well. In FIG. 4C, the plunger is falling through gas and then hits the liquid-gas interface. The plunger then falls through the liquid. The pulse interval C between pulses decreases from the pulse interval B which occurred while the plunger was falling through gas. The pulse intervals A and C are likely to be not equal to one another due to the movement of the plunger and the liquid media that now surrounds the plunger in FIG. 4C. The amplitude of the pulses becomes attenuated when the plunger is in the liquid. In FIG. 4D, the plunger is rising toward the surface. The pulse interval D decreases and the amplitude may increase. The intervals D are less than the interval A.

Thus, by receiving the plunger pulses and determining the intervals between pluses, the movement of the plunger in the tubing can be determined and tracked.

Figure 5:
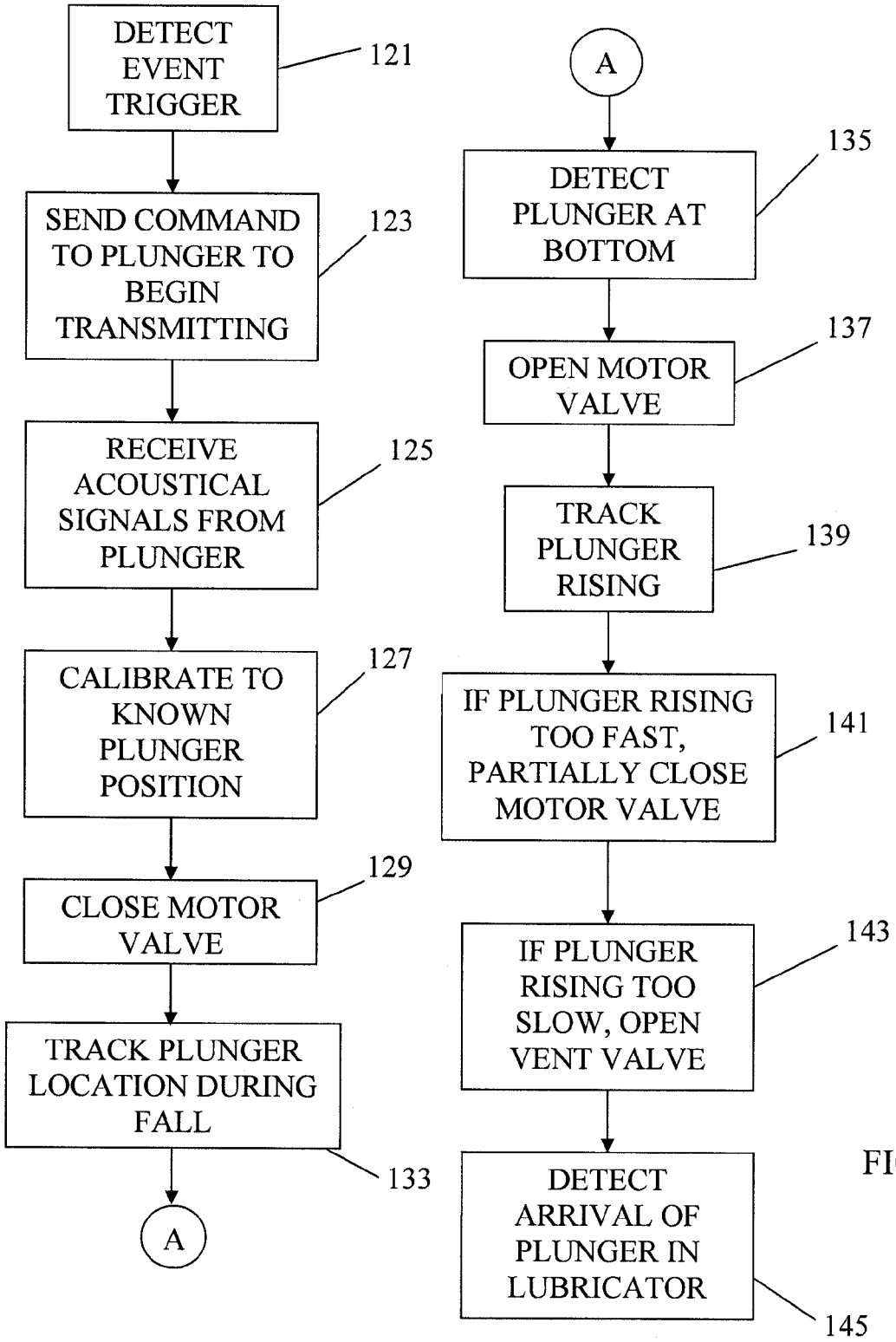
FIG. 5 is a flow chart of operations performed by the surface controller.

The operation of the plunger lift system will now be described, with particular reference to FIGS. 1, 3 and 5. FIG. 5 illustrates the operation of the computer software or programs in the surface controller 35.

The plunger 25 is normally held in the lubricator 29 until needed. In particular, the plunger is held in the lubricator 29 by gas pressure when the well is open. The well is typically flowing through the opened motor valve 33 and the sales line 31. When the well is closed, the plunger 25 falls to the bottom of the well. Alternatively, a plunger catcher can be utilized to catch and drop the plunger independently of the well gas flow.

The surface controller 35 waits for an event trigger to close the well and initiate the drop of the plunger into the well, step 121 (see FIG. 5). The event trigger can be a time interval, a gas flow rate, a pressure or pressures, tank fluid levels, etc. For a time interval, the controller 35 uses the clock 83 to determine when a predetermined period has elapsed. For example, the event trigger can occur every four hours. The time interval can be adjusted according to the liquid level in the tubing. For example, if the liquid level increases over successive plunger drops, then the time interval between drops can be shortened. Conversely, if the liquid level decreases over successive plunger drops, then the time interval between drops can be lengthened. For gas flow rate, the controller 35 determines when the gas flow from the well reaches a predetermined rate. For example, an event trigger would occur if the gas flow falls below a certain rate. Pressure can also be used as an event trigger. For example, if the casing tubing, the tubing pressure or the sales line pressure falls below predetermined levels, an event trigger occurs. As another example, an event trigger can utilize differential pressures such as the differential pressure across the motor valve 33, between the casing 13 and sales line 31, or between the tubing 19 and sales line 31. An event trigger based on the fluid level of the tank monitors the well liquid in the tank. When the level reaches a predetermined point, an event is triggered. Still another type of event trigger can utilize a combination of variables such as pressures, flow rates, tank liquid levels, etc.

When an event trigger is detected, step 121, the surface controller 35 then prepares to close the well, which drops the plunger down the tubing. If the transmitter is not turned on, then the controller 35 sends a command to the plunger to begin transmitting, step 123. The command is sent by way of the surface transmitter 95 to the plunger receiver 69. This activates the plunger transmitter 63 so that pulses are transmitted continuously during the drop and the ascent of the plunger in the tubing. Alternatively, if the plunger is only manually shut off, then step 123 is skipped as the plunger transmitter operates continuously, even when in the lubricator between drops. The surface controller 35 receives, by way of the microphone 43, the plunger pulses 101, step 125, which pulses are illustrated in FIG. 4A, and proceeds to calibrate to a known plunger position, step 127. While the plunger 25 is located in the lubricator 29, the surface controller 35 records the pulse interval A and amplitude for calibration purposes. The surface controller 35 also records the plunger position as being in the lubricator 29.

After calibration, the surface controller controls the solenoid valve 34, which in turn causes the motor valve 33 to close, step 129, in order to shut in the well and stop the flow of gas. The controller 35 may execute other routines related to the closing of the motor control valve before signaling the solenoid valve 34 to close the motor valve 33. When the well is shut in, the plunger 25 falls down the tubing 19 first through gas 111 and then through liquid 113 (see FIG. 1). The top level of the liquid is a gas-liquid interface 115.

During the descent of the plunger, the surface controller 35 tracks the position and rate of descent of the plunger 25, step 133. The controller tracks the plunger from the received acoustical signals 101, which are illustrated in FIG. 4B. The surface controller determines the position of the plunger by tracking the elapsed time from when the controller 35 closed the motor valve 33, causing the plunger to descend and also the times of arrival of the pulses at the arrival sensor 45. As the plunger drops lower in the well, the time of arrival of each pulse at the arrival sensor increases, or becomes later, as illustrated in FIG. 4B. The controller determines the rate of descent from the times of arrival of the pulses. The slower that the times of arrival become, relative to the stationary pulse interval A (see FIG. 4A), the faster the rate of descent of the plunger. Knowing the speed of the plunger, the controller determines the position or location of the plunger in the tubing, relative to the lubricator 29.

Knowing the speed of sound through the gas and the liquid allows the depth of the plunger at each pulse to be directly determined. The speed of sound can be determined from published materials, such as the American Gas Association Report # 10 "Speed of Sound in Natural Gas and Other Related Hydrocarbon Gases", or empirically. Because the plunger transmits at a constant rate, the start time of each pulse is known. The arrival time of each pulse is determined by the sensor 45 and by the controller 35. Thus, the speed and travel time of each pulse is known, which allows the determination of depth or distance. Comparing the depths of the plunger at different pulses, over time, allows the determination of the plunger speed.

As the plunger hits the gas-liquid interface 115 (see FIG. 1), the velocity of the plunger will slow significantly as shown in FIG. 4C. The position of the plunger is recorded and correlated to the liquid level, which is the location of the gas-liquid interface 115. Even though the plunger moves slowly, the interval C between the pulses is greater than the interval A when the plunger is stationary. When the plunger 25 comes to rest on the bumper spring 23, it will stop moving entirely. The pulse train received by the surface controller looks similar to that of FIG. 4A, but at a reduced amplitude. The interval A between the pulses is constant, indicating that plunger is on the bottom. The surface controller detects the plunger is on the bottom from the intervals, step 135. In addition, the controller can look for the change in the pulses due to the plunger passing the gas-liquid interface and use this detected change as a check to begin looking for the time when the plunger becomes stationary.

Because the position of the plunger in the well is monitored and not estimated, little or no time margin is required to allow the plunger to come to rest on the bottom. After the controller detects the plunger on the bottom, the controller executes the next command in its algorithm controlling when the motor valve 33 is to be opened. The motor valve is opened, step 137. The pressure of gas below the plunger forces the plunger 25, and the liquid 113 above the plunger, toward the surface. The plunger continues to transmit. The pulses arriving at the surface controller are illustrated in FIG. 4D. The surface controller tracks the position and rate of rise of the plunger in the tubing by the intervals between pulses, step 139.

In the preferred embodiment, the surface controller 35 maintains the ascent speed of the plunger within a desired range. The surface controller determines if the plunger is rising too fast, step 141. If so, then the motor valve 33 is partially closed to partially shut in the well and slow down the plunger speed to a desired level. The surface controller 35 also determines if the plunger is rising too slow, step 143. If so, then surface controller opens the vent valve 39 to increase the plunger speed to a desired level. Steps 141 and 143 are optional.

As the plunger nears the surface, the liquid 113 is produced into the sales line 31. When the plunger arrives in the lubricator 29, it is held in place by the up flow of gas. The arrival sensor 45 sends a signal, wherein the surface controller 35 detects when the plunger 25 arrives in the lubricator 29, step 145.

The process repeats upon the detection of an event trigger, step 121.

With the present invention, well production can be optimized. As production degrades due to accumulation of liquid at the bottom of the tubing, the plunger is dropped. Dropping the plunger requires the well to be shut in. However, the present invention minimizes the length of time of the shut in, by determining when the plunger is on the bottom and then opening the well again.

Tracking the plunger position also allows the plunger rise to be optimized to further minimize the time the well is shut in and to minimize any damage to equipment that may occur by a plunger rising too fast. The plunger can be slowed down or sped up to adjust the rise time.

The present invention also determines the liquid level in the tubing based on the abrupt change in pulse intervals. The liquid levels are stored. Changes in the liquid level can be used to adjust the frequency that the plunger is dropped. For example, if the well begins producing more liquid each day, the liquid levels will rise. In order to compensate, the plunger can be dropped more frequently. Consequently, if the well produces less liquid each day, then the plunger can be dropped with less frequency.

The foregoing disclosure and showings made in the drawings are merely illustrative of the principles of this invention and are not to be interpreted in a limiting sense.

The invention claimed is:

1. A plunger lift system for use in a well in the earth, comprising:

a) a plunger, the plunger having a transmitter that produces acoustical signals, the plunger capable of exiting a lubricator on the surface and entering the well, and moving up and down in the well, and reentering the lubricator, the plunger transmitter operating while the plunger is in the well and independently of a liquid level in the well;

b) a receiver located so as to receive the signals from the plunger transmitter, the receiver receiving the signals when the plunger is in the well;

c) a controller that opens and closes the well, the controller operatively connected to the receiver, the controller determining the location of the plunger in the well from the plunger transmitter signals;

d) the plunger further comprising a clock, the transmitter producing signals at a constant time interval.

2. A plunger lift system for use in a well in the earth, comprising:

a) a plunger, the plunger having a transmitter that produces acoustical signals, the plunger capable of exiting a lubricator on the surface and entering the well, and moving up and down in the well, and reentering the lubricator, the plunger transmitter operating while the plunger is in the well and independently of a liquid level in the well;

b) a receiver located so as to receive the signals from the plunger transmitter, the receiver receiving the signals when the plunger is in the well;

c) a controller that opens and closes the well, the controller operatively connected to the receiver, the controller determining the location of the plunger in the well from the plunger transmitter signals;

d) the controller determines the velocity of the plunger in the well from the plunger transmitter signals.

3. A plunger lift system for use in a well in the earth, comprising:

a) a plunger, the plunger having a transmitter that produces acoustical signals, the plunger capable of exiting a lubricator on the surface and entering the well, and moving up and down in the well, and reentering the lubricator, the plunger transmitter operating while the plunger is in the well and independently of a liquid level in the well;

b) a receiver located so as to receive the signals from the plunger transmitter, the receiver receiving the signals when the plunger is in the well;

c) a controller that opens and closes the well, the controller operatively connected to the receiver, the controller determining the location of the plunger in the well from the plunger transmitter signals d) a transmitter located at the surface and operatively connected to the controller;

e) a receiver located in the plunger and coupled to a controller in the plunger, the plunger controller controlling the operation of the plunger transmitter.

4. A plunger lift system for use in a well in the earth, comprising:

a) a plunger, the plunger having a transmitter that produces acoustical signals, the plunger capable of exiting a lubricator on the surface and entering the well, and moving up and down in the well, and reentering the lubricator, the plunger transmitter operating while the plunger is in the well and independently of a liquid level in the well;

b) a receiver located so as to receive the signals from the plunger transmitter, the receiver receiving the signals when the plunger is in the well, c) a controller that opens and closes the well, the controller operatively connected to the receiver, the controller determining the location of the plunger in the well from the plunger transmitter signals;

d) the controller determines a liquid level in the well from the plunger transmitter signals.

5. The plunger lift system of claim 4, wherein:

a) the plunger further comprises a clock, the transmitter producing signals at a constant time interval;

b) the controller determines the velocity of the plunger in the well from the signals;

c) the controller determines a liquid level in the well from the plunger transmitter signals.

6. A method of determining the location of a plunger in a plunger lift system for a well, comprising the steps of:

a) controlling the movement of the plunger in the well between the surface and the well bottom by opening and closing the well;

b) transmitting acoustical signals from the plunger independently of the plunger moving within the well;

c) allowing the plunger to move in the well;

d) receiving the plunger signals;

e) determining the location of the plunger in the well from the plunger signals;

f) determining the location of a gas-liquid interface in the well from the plunger signals.

7. The method of claim 6 wherein the step of controlling the movement of the plunger in the well between the surface and the well bottom by opening and closing the well further comprises the step of using the location of the gas-liquid interface to determine when to open or close the well.

8. A method of determining the location of a plunger in a plunger lift system for a well, comprising the steps of:

a) controlling the movement of the plunger in the well between the surface and the well bottom by opening and closing the well;

b) transmitting acoustical signals from the plunger independently of the plunger moving within the well;

c) allowing the plunger to move in the well;

d) receiving the plunger signals;

e) determining the location of the plunger in the well from the plunger signals;

f) transmitting signals from the plunger further comprises the step of transmitting pulses at a constant interval.

9. The method of claim 8 wherein the step of determining the location of the plunger further comprising the step of determining the direction of travel of the plunger in the well from the plunger signals and the intervals.

10. The method of claim 8 further comprising the step of determining the location of a gas-liquid interface in the well from the plunger signals and the intervals.

11. A method of determining the location of a plunger in a plunger lift system for a well, comprising the steps of:

a) controlling the movement of the plunger in the well between the surface and the well bottom by opening and closing the well;

b) transmitting acoustical signals from the plunger independently of the plunger moving within the well;

c) allowing the plunger to move in the well;

d) receiving the plunger signals;

e) determining the location of the plunger in the well from the plunger signals;

f) detecting, from the plunger signals and the intervals, when the plunger has reached the well bottom.

12. The method of claim 11 further comprising the step of, after detecting when the plunger has reached the well bottom, opening the well.

* * * * *